US006036895A

United States Patent [19]

Büdenbender et al.

[11] Patent Number: 6,036,895

[45] Date of Patent: Mar. 14, 2000

[54] PROCESS AND DEVICE FOR THE FORMATION OF MONOFILAMENTS PRODUCED BY MELT-SPINNING

[75] Inventors: Jürgen Büdenbender; Eckhard Gärtner, both of Dormagen, Germany

[73] Assignee: Bayer Faser GmbH, Dormagen, Germany

[21] Appl. No.: 09/101,044

[22] PCT Filed: Dec. 23, 1996

[86] PCT No.: PCT/EP96/05810

§ 371 Date: Jun. 25, 1998

§ 102(e) Date: Jun. 25, 1998

[87] PCT Pub. No.: WO97/25458

PCT Pub. Date: Jul. 17, 1997

[30] Foreign Application Priority Data

Jan. 3, 1996 [DE] Germany ..... 196 00 090

[51] Int. Cl.[7] ..... D01D 5/092; D01D 5/16; D01D 10/02

[52] U.S. Cl. ..... 264/28; 264/130; 264/178 F; 264/210.7; 264/210.8; 264/211.14; 264/211.15; 264/211.17; 264/235.6; 425/66; 425/71; 425/378.2; 425/379.1; 425/382.2; 425/445; 425/464

[58] Field of Search ..... 264/28, 130, 178 F, 264/210.7, 210.8, 211.14, 211.15, 211.17, 235.6; 425/66, 71, 378.2, 379.1, 382.2, 445, 464

[56] References Cited

U.S. PATENT DOCUMENTS

| | | | |
|---|---|---|---|
| 5,019,316 | 5/1991 | Ueda et al. | 264/178 F |
| 5,362,430 | 11/1994 | Herold, II et al. | 264/103 |
| 5,518,670 | 5/1996 | Büdenbender et al. | 264/28 |

FOREIGN PATENT DOCUMENTS

| | | |
|---|---|---|
| 4129521 | 3/1993 | Germany . |
| 9111547 | 8/1991 | WIPO . |

OTHER PUBLICATIONS

S. Braun, Handbuch der Kunststoff–Extrusionstechnik II [manual of plastics extrusion II], Carl Hanser Verlag, Munich, Vienna, (1986), pp. 2295–2319.

*Primary Examiner*—Leo B. Tentoni
*Attorney, Agent, or Firm*—Norris, McLaughlin & Marcus, P.A.

[57] ABSTRACT

A continuous process and apparatus for the production of melt-spun monofilaments having a diameter of 60 μm to 2500 μm from fiber-forming polymers, wherein the polymer melt is spun into air from a spinning head, laterally quenched in a spinning cabinet with a defined air velocity profile and then cooled in a liquid bath.

23 Claims, 3 Drawing Sheets

PROCESS AND DEVICE FOR THE FORMATION OF MONOFILAMENTS PRODUCED BY MELT-SPINNING

This invention relates to a continuous process and an apparatus for the production of melt-spun monofilaments having a diameter of 60 μm to 2500 μm from fibre-forming polymers, in particular polyamide. In this process, the polymer melt is spun into air from a spinning head, laterally quenched in a spinning cabinet with a defined air velocity profile and then cooled in a liquid bath.

BACKGROUND OF THE INVENTION

Processes for the production of monofilaments from thermoplastic polymers without additional air quenching between the spinning head and spinning vat containing a liquid coolant are known in principle. *Handbuch der Kunststoff-Extrusionstechnik II* [manual of plastics extrusion II], Carl Hanser Verlag, Munich, Vienna, 1986, pages 295 to 319 describes the known process stages in detail. According to this reference, thermoplastic monofilaments (having a diameter of greater than 60 μm) may be produced by spinning, for example in water, at a delivery speed of the finished monofilaments of at most 600 m/min.

Monofilaments of a substantially smaller cross-section and multi-filament fibres are directly spun into air as the coolant at a distinctly higher delivery speed using other processes. German published patent application DE 41 29 521 A1 thus describes an apparatus for high speed spinning multi-filament fibres at a windup speed of at least 2000 m/min.

In the latter-stated process. monofilaments or multi-filament fibres are spun into air and directly wound up. One particular feature of this process is the cooling apparatus used therein. It consists of a porous pipe open in the direction of spinning and arranged concentrically relative to the tow. Given the elevated windup speed, no cooling medium is actively supplied. The process described therein relates to filament yarns with the filaments having an individual linear density of 0.1 to 6 dtex and is not applicable to monofilaments having a diameter of greater than 50 μm (approx. 22 dtex).

International patent application WO 91/11547 describes a process and apparatus for high speed spinning of monofilaments having an individual linear density of 1 to 30 dtex (corresponding to approx. 10 to 57 μm). In this process, the melt-spun monofilaments are cooled with an air blast, drawn over a friction element, provided with a finish and wound up at a speed of up to 6000 m/min. This process differs fundamentally from the process according to DE 41 29 521 A1 with regard to the active cooling of the monofilament by an air blast and by the use of a friction element, by means of which fibre tension is adjusted.

Both direct spinning/stretching processes (according to DE 41 29 520 A1 and WO 91/11547) are in principle limited to the production of small diameter monofilaments (i.e. having a fibre diameter of <57 μm) due to unfavourable heat dissipation brought about by air cooling and the poor internal thermal conductivity of the fibres.

German patent application bearing the file number P 43 36 097.1 describes a continuous high speed production process for the production of melt-spun monofilament fibres having a diameter of 60 μm to 500 μm. In this process, the polymer fibres formed are laterally quenched over a zone of 1 to 10 cm beneath the spinning head with temperature-controlled air from nozzles in order to stabilise the smooth running of the fibres. After the air cooling, the polymer filaments are cooled in a liquid bath.

The surface of the melt fibres which have only passed through a short air zone, for example as in the last-stated process, and have then been directly spun into a liquid exhibits a texture similar to orange peel. The monofilaments exhibit a loss of strength and a wide dispersion of their knot strength.

Moreover, the sudden cooling of the monofilaments in the cooling liquid gives rise to a pronounced core/shell structure in the filaments which also degrades the mechanical properties of the filaments.

Due to the unfavourable dissipation of heat on air cooling and poor internal thermal conductivity in such processes in which only air is used as the cooling medium, monofilament production is limited to a diameter of <57 μm.

Additional air quenching between the spinning head and spinning bath by nozzles over an air zone of 1 to 10 cm (corresponding to DE 43 36 097) gives rise to satisfactory textile characteristics in thin monofilaments (having a diameter of <200 μm) spun at high speed. Use of the stated air cooling zone is not sufficient for thicker monofilaments. Moreover, the process is extremely sensitive to air movement in the fibre forming zone, so impairing the operational reliability of the plant.

SUMMARY OF THE INVENTION

The object underlying the invention is to improve the stated spinning processes for monofilaments in such a manner that spinning reliability and the textile characteristics of the resultant monofilaments, in particular the knot strength thereof, are improved.

This object is achieved according to the invention bit a continuous process for the production of monofilament fibres having a diameter of 60 μm to 2000 μm from fibre-forming thermoplastic polymers by melt-spinning of the molten polymer from a spinning head into air, lateral quenching with cooling gas in a spinning cabinet, cooling of the formed fibres in a liquid bath, removal of adhering liquid, optionally applying a finish, stretching the fibres in one or more stages, setting and winding the fibres at a delivery speed of the set fibres of 100 to 4000 m/min, characterised in that the cooling gas has a temperature of 0 to 50° C. and that the cooling gas exhibits a velocity profile which decreases in the running direction of the fibres, measured perpendicularly to the running direction of the fibres, and that the cooling liquid has a temperature of −10 to 150° C.

DETAILED DESCRIPTION

The fibre-forming polymer is in particular melt-spun into air from a melt-spinning head which is known per se, quenched laterally in a spinning cabinet with temperature-controlled air (of a temperature of 0° C. to 50° C.) following a defined air velocity profile, preferably from one side from nozzles or, in the case of round spinnerets, from annular nozzles and then cooled in a liquid bath at a temperature of 5° C. to 50° C.

In a preferred variant, the transverse air velocity relative to the monofilaments immediately below the spinneret (for example at a distance of 0.5 to 6 cm from the spinneret) is 0.1 to 10 m/sec, in particular of 0.1 to 2 m/sec, and falls over the length of the spinning cabinet to a lower, but, relative to the longitudinal section of the spinning cabinet, extremely uniform air velocity of 0.001 m/sec to 1 m/sec, in particular of 0.01 to 0.2 m/sec.

In a preferred process, the cooling gas flows from nozzles, which are arranged annularly around the fibres in the spinning cabinet, into the spinning cabinet and the cooling gas, together with the vapours released by the spun fibres, is exhausted below the nozzles.

In another variant of the process, the nozzles are arranged on one side of the spinning cabinet and the cooling gas, together with the vapours released by the spun fibres, is exhausted opposite the nozzles.

Another preferred process is that using a spinning cabinet which covers the distance between the spinning head and the liquid bath. The spinning cabinet may have a length of 2 to 200 cm. The spinning cabinet preferably has a length of 8 to 60 cm.

In a preferred variant of the process, the transverse air velocity in the spinning cabinet relative to the monofilaments is 0.05 to 10 m/sec, in particular 0.1 to 2 m/sec, at a distance of 0.5 to 6 cm from the spinneret. In particular at a distance of 6 to 200 cm from the spinneret. the air velocity in the spinning cabinet is 0.001 m/sec to 1 m/sec, preferably 0.01 to 0.2 m/sec.

The monofilaments are preferably quenched in the spinning cabinet with emperature-controlled air of a temperature of 0 to 50° C., in particular of 10 to 30° C.

In another preferred variant of the process, the air introduced into the spinning cabinet, together with the vapours released by the spun fibres, is exhausted opposite the air inlet uniformly over the entire spinning cabinet. In particular when the spinning gas is exhausted from the spinning cabinet, a pressure differential of the order to 10 to 100 Pa relative to ambient pressure is produced.

The temperature of the cooling bath is preferably 5 to 50° C.

The delivery speed of the fibres is preferably 1000 to 3500 m/min. The monofilaments obtainable from the process in particular have a diameter of 100 to 400 $\mu$m, preferably of 180 to 250 $\mu$m.

Fibre-forming polymers which may be considered are in particular polyamide, polyethylene terephthalate, polybutylene terephthalate, polypropylene and polyethylene. The preferred polymer is polyamide, in particular polyamide 6, polyamide 6,6, polyamide 6,10, polyamide 6,12, polyamide 11, polyamide 12, a blend of the stated polyamides or a copolyamide of the stated polyamides. Particularly preferred polymers are a copolyamide consisting of polyamide 6 and polyamide 6,6, a copolyamide of polyamide 6 and polyamide 12 and a copolyamide consisting of polyamide 6 and polyamide 11. Another preferred copolyamide consists of polyamide 6, polyamide 6,6 and either polyamide 11 or polyamide 12.

In another preferred variant, the bottom of the spinning cabinet ends at the surface of the cooling liquid in the spinning bath.

After leaving the liquid bath, the monofilaments have any adhering cooling liquid removed in the conventional manner and are post-treated by optional application of a finish, stretching and setting. The monofilaments are then wound onto reels.

The monofilaments produced using the described novel "dry/wet" melt-spinning process are distinguished by a smoother surface and a higher work capacity (defined as the product of breaking tenacity and maximum tensile elongation).

By means of the described defined air cooling, in particular in the event of compliance with the preferred flow profile, a smooth fibre surface is produced and the monofilament shell is gently cooled such that the core/shell structure is less pronounced than in conventional processes (spinning through a small air gap into a liquid bath).

The described spinning process according to the invention is in particular required at a higher production speed of 600 to 3000 m/min in order to achieve the textile characteristics required of monofilaments.

The melt-spinning process according to the invention is preferably used for the production of fishing lines, in particular for high-strength, transparent fishing lines and for the production of industrial monofilaments, in particular at a relatively high production speed (>600 m/min) or an increased number of spinneret holes.

The transparency and especially the knot strength of, for example, fishing lines made from the monofilaments are substantially improved by the spinning process according to the invention.

The present invention also provides an apparatus for the performance of the process according to the invention consisting of a melt-spinning head with a spinneret, a spinning cabinet with a quenching unit and exhausting unit, a liquid bath with fibre guides and baffles, wipers and an adhering liquid aspirator, optionally a finish application station, one or more stretching units, in particular for hot stretching, a setting zone and windup stations. The apparatus is characterised in that the spinning cabinet surrounds the space between the spinning head and surface of the cooling liquid bath or in particular encloses it in a gas-tight manner.

In particular, gas nozzles for quenching the monofilaments in the spinning cabinet are provided on one side of the cabinet, which nozzles are optionally provided with flow smoothers in the area of the monofilaments.

In a preferred apparatus, the first nozzle in the spinning cabinet below the spinneret is a flat nozzle with an adjustable slot. Preferably, all the spinning cabinet air nozzles may be separately controlled so that the air streams may be adjusted in accordance with the required air flow profile.

One variant of the apparatus has an annular nozzle to quench the monofilaments in the spinning cabinet with flow smoothers to render the gas velocity profile uniform upstream from the nozzle. Another preferred apparatus has an annular exhaust below the annular nozzle, by means of which the air introduced into the spinning cabinet together with the vapours released by the spun fibres may be exhausted. A preferred apparatus is one in which the exhaust unit in the spinning cabinet is arranged opposite the air inlet nozzles.

FIGS. 1 to 3 below provide a more detailed. non-limiting illustration of the invention.

EXAMPLES

General Process Description

Figure 1:
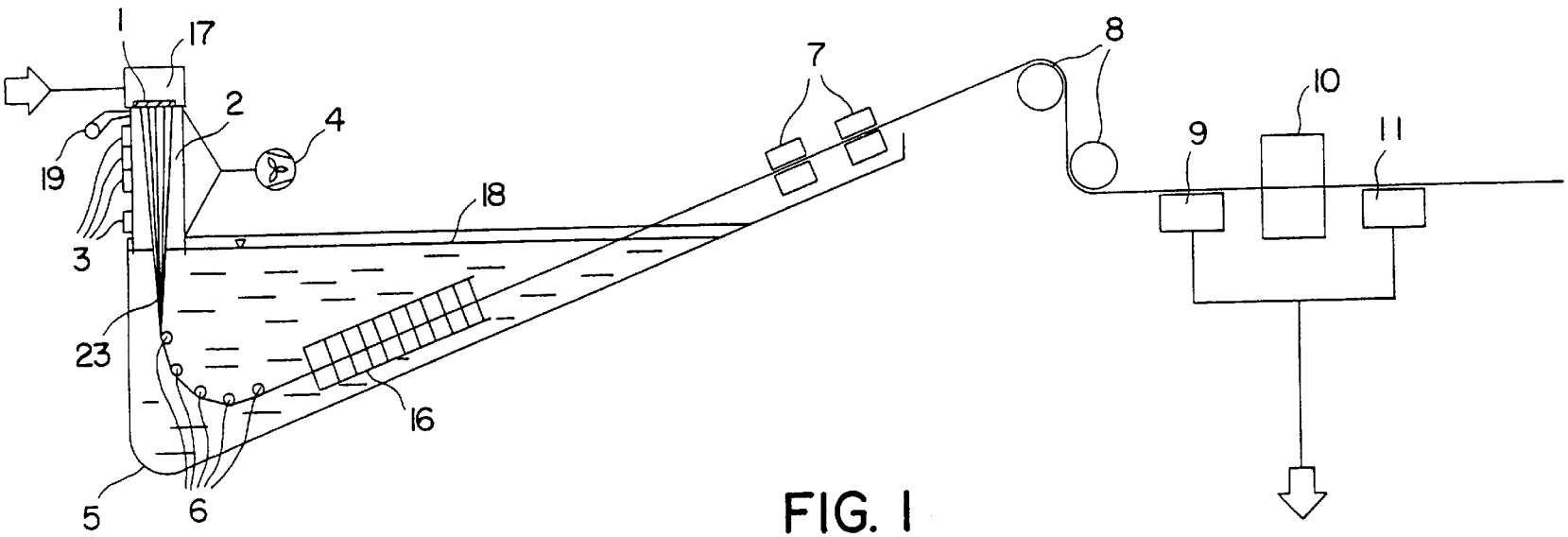
FIG. 1: A schematic view of the upstream section of the spinning apparatus according to the invention.

The polymer melt is introduced via a line into the melt-spinning head 17 with the spinneret 1 (c.f FIG. 1). The spinning cabinet 2 has an air quenching unit 3 and exhaust unit 4, which introduce and remove the cooling air and are arranged opposite each other as shown in FIG. 1. An additional slot nozzle 19 with flow smoothers 21 to render the gas velocity profile uniform upstream from the nozzle 19 is arranged above the quenching unit.

Figure 2:
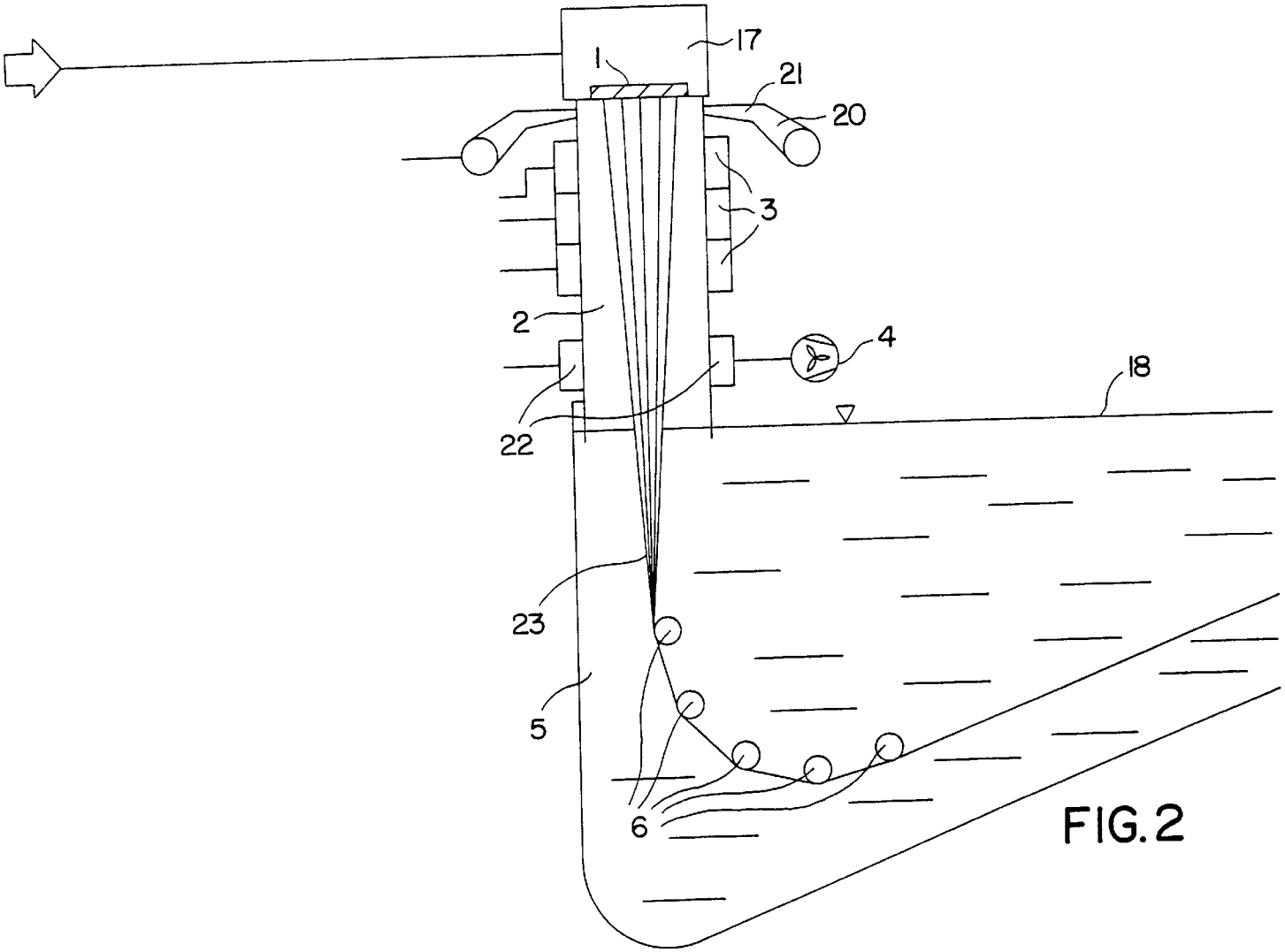
FIG. 2: An enlarged view of the spinneret and cooling bath from one variant of the spinning apparatus of FIG. 1 according to the invention.

In one variant of the apparatus according to FIG. 2, the exhaust unit 4 has an annular exhaust channel 22 which passes around the spinning cabinet 2, which channel ensures spatially uniform discharge of the spinning gas. The slot nozzle 19 is replaced by an annular nozzle 20 and annular nozzles with flow smoothers are provided as the quenching unit 3.

In both variants, the tow 23 of monofilaments is precooled in the spinning cabinet 2 by quenching with air.

Figure 3:
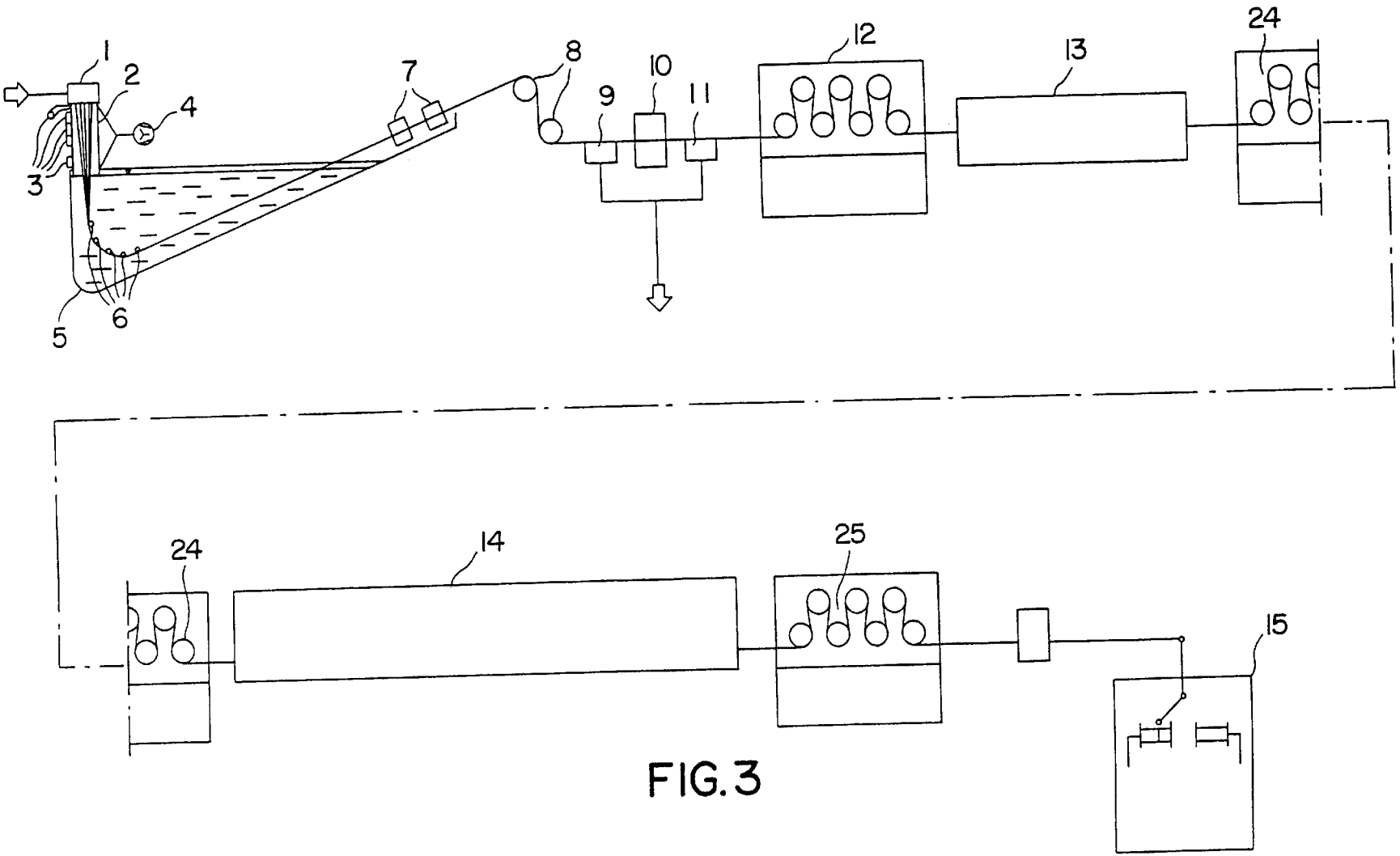
FIG. 3: A schematic view of the entire spinning apparatus with a post-treatment section.

The tow 23 is then further cooled and solidified in a liquid bath 5. A fibre guide 6 ensures a gentle change in the running direction of the tow 23 by means of a plurality of guide bars. Baffles 16 in the cooling bath calm the cooling bath liquid at elevated production speeds in order to avoid turbulence in the cooling bath liquid brought about by liquid entrained by the monofilaments and to prevent impact on the monofilaments, which are still soft (c.f. FIG. 1). Since cooling bath liquid is entrained from the cooling bath 5 at high monofilament delivery speeds, liquid wipers 7 are arranged downstream from the exit of the monofilaments 23 from the cooling bath liquid and upstream from the pair of haul-off rolls 8. which wipers, together with an adhering liquid aspirator 9, remove the entrained cooling bath liquid from the monofilaments 23. The spinning apparatus furthermore has a finish application station 10 and subsequent aspirator 11 for excess finish. a hot stretching zone 13, a setting zone 14 and winders 15 to wind the monofilaments. The running speed of the seven-roller units 12, 24 and 25 determine the extent of drawing in the hot stretching zone 13 and the setting zone 14 (c.f. FIG. 3).

In both variants of the apparatus, the spinning cabinet 2 of the spinning apparatus is arranged in such a manner that the spinning cabinet 2 encloses the space between the spinning head 17 and liquid surface 18 of the cooling liquid bath 5, in which the monofilaments are formed, in a gas-tight manner.

A variant of the apparatus as shown in FIG. 1 was used for the following Examples. However, gas-tight enclosure of the space between the spinning head 17 and liquid surface 18 was not provided by the spinning cabinet 2. One or three opposing nozzles 19 and 3*a*, 3*b* were used for quenching. The width of the nozzles in each case covered the width of the tow.

The nozzle 19 was a slot nozzle at the heights stated in each of the Examples. Nozzles 3*a* and 3*b* were nozzles equipped with flow smoothers, the height of which approximately covered the remaining height beneath the spinneret.

Example 1

Monofilaments of a diameter of 0.40 mm were produced under the above-stated standard conditions from a commercially available copolyamide with the trade name Ultramid C 35 (manufacturer: BASF AG, Ludwigshafen). The distance between the discharge of the melt from the spinneret orifice and the surface of the cooling medium (water) was 60 mm.

A slot nozzle 19 having a slot height of 25 mm was installed in this zone, by means of which the monofilaments were quenched with air in a defined manner between leaving the spinneret and entering the cooling medium. Table 1 shows the measured linear and knot strengths of the resultant monofilaments.

Quenching nozzles were omitted for the Comparative Example in Table 1. In the zone between the spinning head 17 and the surface of the cooling liquid, the tow was passed through ambient air for a distance of 15 mm.

TABLE 1

| | Monofilament diameter [mm] | Maximum tensile force [daN] | Maximum tensile elongation [%] | Breaking tenacity [cN/tex] linear/knot |
|---|---|---|---|---|
| Comparison | 0.40 | 11.99 | 20.15 | 80.05/60.29 |
| Process according to the invention | 0.40 | 12.33 | 21.53 | 81.53/65.66 |

Example 2

Monofilaments of a diameter of 0.20 mm were produced under the stated standard conditions from a commercially available polyamide with the trade name Durethan B 31 (manufacturer: BASF AG, Ludwigshafen). The distance between the discharge of the melt from the spinneret orifice and the surface of the cooling medium (water) was 280 mm.

Quenching nozzles were omitted for the Comparative Example in Table 2. In the zone between the spinning head 17 and the surface of the cooling liquid, the tow was passed through ambient air for a distance of 15 mm.

TABLE 2

| | Air velocities Air [m/sec] Nozzles: 19/3a/3b | Slot height [mm] (slot nozzle 19) | [mm] Monofilament diameter | Maximum tensile force [daN] | Maximum tensile elongation [%] | Breaking tenacity [cN/tex] linear |
|---|---|---|---|---|---|---|
| Comparison | none/none/none | none | 0.20 | 1.58 | 26.6 | 42.1 |
| Process according to the invention | 1.5/0.5/0.5 | 5.0 | " | 1.72 | 27.8 | 45.9 |
| Process according to the invention | 1.5/0.5/0.5 | 25.0 | " | 1.84 | 30.2 | 50.6 |
| Process according to the invention | 5.0/1.5/1.5 | 25.0 | " | 1.76 | 29.2 | 47.4 |

Example 3

Monofilaments of various diameters were produced under the stated standard conditions from a commercially available copolyamide with the trade name Ultramid C 35 (manufacturer: BASF AG, Ludwigshafen). The distance between the discharge of the melt from the spinneret orifice and the surface of the cooling medium (water) was 60 mm.

A slot nozzle 19 having a slot height of 25 mm was installed in this zone, by means of which the monofilaments were quenched with air in a defined manner between leaving the spinneret and entering the cooling medium. Quenching nozzles were omitted for the Comparative Example in Table 3. In the zone between the spinning head 17 and the surface of the cooling liquid, the tow was passed through ambient air for a distance of 15 mm. The linear and knot strengths measured on the resultant monofilaments are as follows:

TABLE 3

| | Monofilament diameter [mm] | Maximum tensile force [daN] | Maximum tensile elongation [%] | Breaking tenacity [cN/tex] linear/knot |
|---|---|---|---|---|
| Comparison | 1.00 | 64.58 | 18.35 | 72.46/40.54 |
| Process according to the invention | 1.00 | 66.25 | 19.1 | 77.87/53.58 |
| Process according | 0.30 | 7.83 | 21.04 | 90.63/67.75 |
| to the invention | 0.30 | 7.72 | 22.84 | 91.35/74.15 |
| Process according | 0.20 | 3.66 | 20.41 | 94.53/73.71 |
| to the invention | 0.20 | 3.69 | 21.58 | 94.00/77.96 |
| Process according | 0.16 | 2.31 | 21.73 | 90.45/73.96 |
| to the invention | 0.16 | 2.36 | 22.78 | 90.80/77.07 |

We claim:

1. Continuous process for the production of monofilament fibers 23 having a diameter of 60 μm to 2000 μm from fibre-forming thermoplastic polymers by melt-spinning of the molten polymer from a spinning head 17, lateral quenching of the fibers 23 with cooling gas in a spinning cabinet 2, cooling of the formed fibers in a cooling liquid bath 5, removal of adhering cooling liquid 24, optionally applying a finish, stretching the fibers 23 in one or more stages, setting and winding the fibers 23 at a delivery speed of the set fibers 23 of 100 to 4000 m/min, wherein the cooling gas has a temperature of 0 to 50° C., the cooling gas exhibits a defined velocity profile which decreases in the running direction of the fibers and the cooling liquid has a temperature of −10 to 150° C.

2. Process according to claim 1, wherein the cooling gas flows from nozzles 20, which are arranged annularly around the fibers 23 in the spinning cabinet, into the spinning cabinet 2 and the cooling gas, together with the vapors released by the spun fibers 23, is exhausted below the nozzles 20.

3. Process according to claim 1, wherein the cooling gas enters through the quenching unit 3, which is arranged on one side of the spinning cabinet 2, and the cooling gas, together with the vapors released by the spun fibers 23, is exhausted opposite the unit 3.

4. Process according to claim 1, wherein the spinning cabinet 2 isolates the fibers 23 from their surroundings between the spinning head 17 and the liquid bath 5.

5. Process according to claim 1, wherein the spinning cabinet 2 has a length of 2 to 200 cm.

6. Process according to claim 1, wherein the air velocity in the spinning cabinet 2, measured transversely to the haul-off direction of the fibers 23, is 0.05 to 10 m/sec, at a distance of 0.5 to 6 cm from the spinneret 1.

7. Process according to claim 1, wherein the spinning gas velocity in the spinning cabinet 2 is 0.001 m/sec to 1 m/sec, at a distance of 6 to 200 cm from the spinneret 1.

8. Process according to claim 1, wherein the fibers 23 are quenched in the spinning cabinet 2 with temperature-controlled air of a temperature of 0 to 50° C.

9. Process according to claim 1, wherein the air introduced into the spinning cabinet 2, together with the vapors released by the spun fibers 23, is exhausted opposite the air inlet uniformly over the entire spinning cabinet 2.

10. Process according to claim 4, wherein exhausting produces a pressure differential of 10 to 100 Pa relative to ambient pressure in the spinning cabinet 2.

11. Process according to claim 1, wherein the fiber-forming polymer used is a polyamide, polyethylene terephthalate, polybutylene terephthalate, polypropylene or polyethylene.

12. Apparatus for the performance of the process according to claim 1 comprising a melt-spinning head 17 with a spinneret 1, a spinning cabinet 2 with a quenching unit 3 adapted to introduce cooting gas into the spinning cabinet and produce a cooling gas flow in said spinning cabinet having a velocity profile which decreases in the direction running from the spinning head to the liquid bath, an exhausting unit 4, a liquid bath 5 with fibre guides 6 and baffles 16, wipers 7 and an adhering liquid aspirator 9, optionally a spinning finish application station 10, one or more stretching units 12, a setting zone 14 and windup stations 15, wherein the spinning cabinet 2 surrounds the space between the spinning head 17 and surface 18 of the cooling liquid bath 5 in the area of the monofilaments 23.

13. Apparatus according to claim 12, wherein nozzles in the quenching unit 3 are arranged in the spinning cabinet 2 on one side to quench the fibers 23 and are provided with flow smoothers 21.

14. Apparatus according to claim 12, wherein the first nozzle of the quenching unit 3 in the spinning cabinet 2 below the spinneret 1 is an adjustable flat nozzle.

15. Apparatus according to claim 12, wherein all the nozzles of the spinning cabinet 2 are separately controllable to adjust the gas velocity of the nozzles in accordance with the required air flow profile.

16. Apparatus according to claim 12, wherein an annular nozzle with flow smoothers is provided in the spinning cabinet 2 as the quenching unit 3 for the fibers 23.

17. Apparatus according to claim 12, wherein an annular exhaust 22 is provided in the spinning cabinet 2, by means of which the air introduced into the spinning cabinet 2, together with the vapors released by the spun fibers 23, is exhausted below the nozzles.

18. Apparatus according to claim 12, wherein the spinning cabinet 2 contains cooling gas exhausts opposite the air inlet nozzles.

19. Process according to claim 5, wherein said length is 8 to 60 cm.

20. Process according to claim 6, wherein said air velocity is 0.1 to 2 m/sec.

21. Process according to claim 7, wherein said spinning gas velocity is 0.01 to 0.2 m/sec.

22. Process according to claim 8, wherein said temperature is 10 to 30° C.

23. Process according to claim 11, wherein said polymer is a polyamide.

* * * * *

UNITED STATES PATENT AND TRADEMARK OFFICE.

CERTIFICATE OF CORRECTION

PATENT NO : 6,036,895

DATED : March 14, 2000

INVENTOR(S) : Jurgen BUDENBENDER, et al.

It is certified that error appears in the above-identified patent and that said Letters Patent are hereby corrected as shown below:

Column 8, line 22, cancel "cooting" and substitute --cooling--.

Signed and Sealed this

Seventeenth Day of April, 2001

*Attest:*

Nicholas P. Godici

NICHOLAS P. GODICI

*Attesting Officer*

*Acting Director of the United States Patent and Trademark Office*

M.